US010651603B2

(12) United States Patent
Kurudamannil et al.

(10) Patent No.: US 10,651,603 B2
(45) Date of Patent: May 12, 2020

(54) HIGH SPEED ELECTRICAL CONNECTOR

(71) Applicant: Amphenol FCI Connectors Singapore Pte. Ltd., Singapore (SG)

(72) Inventors: Abin Simon Kurudamannil, Cochin (IN); Biju K. Paul Kizhakkamparambil, Cochin (IN); Alex Babu Thuruthummalil, Cochin (IN); Binesh C. Devimandiram, Cochin (IN)

(73) Assignee: Amphenol FCI Connectors Singapore Pte. Ltd., Singapore (SG)

( * ) Notice: Subject to any disclaimer, the term of this patent is extended or adjusted under 35 U.S.C. 154(b) by 0 days.

(21) Appl. No.: 16/305,538

(22) PCT Filed: May 31, 2017

(86) PCT No.: PCT/SG2017/050277

§ 371 (c)(1),
(2) Date: Nov. 29, 2018

(87) PCT Pub. No.: WO2017/209694

PCT Pub. Date: Dec. 7, 2017

(65) Prior Publication Data

US 2020/0083648 A1 Mar. 12, 2020

(30) Foreign Application Priority Data

Jun. 1, 2016 (IN) ..... 201641018893

(51) Int. Cl.
*H01R 13/6581* (2011.01)
*H01R 12/72* (2011.01)
(Continued)

(52) U.S. Cl.
CPC ..... *H01R 13/6581* (2013.01); *H01R 12/716* (2013.01); *H01R 12/724* (2013.01);
(Continued)

(58) Field of Classification Search
CPC ..... H01R 13/65802; H01R 13/648; H01R 13/6585; H01R 13/6581; H01R 13/6471;
(Continued)

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1306684 A 8/2001
CN 2519434 Y 10/2002
(Continued)

OTHER PUBLICATIONS

EP 11166820.8, Jan. 24, 2012, Extended European Search Report.
(Continued)

*Primary Examiner* — Gary F Paumen
(74) *Attorney, Agent, or Firm* — Wolf, Greenfield & Sacks, P.C.

(57) ABSTRACT

An electrical connector comprises a housing having a mating direction, a width direction orthogonal to the mating direction and a height direction orthogonal to the mating direction and the width direction. Low speed signal contacts and high speed signal contacts are arranged in the housing. Ground bars are each disposed between adjacent two of the contacts. A support member is attached to the housing and engaged to the ground bars. The support member has a main body disposed along the width direction and fingers extending laterally from the main body. Each of the fingers being in alignment with one of the low speed signal contacts along the mounting direction. The fingers are positioned away from the high speed contacts to achieve better signal integrity and crosstalk reduction.

18 Claims, 9 Drawing Sheets

(51) Int. Cl.

| | |
|---|---|
| ***H01R 13/6471*** | (2011.01) |
| ***H01R 12/71*** | (2011.01) |
| ***H01R 13/514*** | (2006.01) |
| ***H01R 43/20*** | (2006.01) |

(52) U.S. Cl.

CPC ..... *H01R 13/514* (2013.01); *H01R 13/6471* (2013.01); *H01R 43/20* (2013.01)

(58) Field of Classification Search

CPC .. H01R 13/514; H01R 12/724; H01R 12/716; H01R 43/20; H01R 23/688; H01R 23/6873

USPC ..... 439/95, 108, 607.05, 607.07, 607.34, 439/607.35

See application file for complete search history.

(56) References Cited

U.S. PATENT DOCUMENTS 3,134,950 A 5/1964 Cook
3,322,885 A 5/1967 May et al.
3,786,372 A 1/1974 Epis et al.
3,825,874 A 7/1974 Peverill
3,863,181 A 1/1975 Glance et al.
4,155,613 A 5/1979 Brandeau
4,195,272 A 3/1980 Boutros
4,276,523 A 6/1981 Boutros et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,601,527 A * 7/1986 Lemke ..... H01R 23/6873 439/81
4,636,752 A 1/1987 Saito
4,682,129 A 7/1987 Bakermans et al.
4,751,479 A 6/1988 Parr
4,761,147 A 8/1988 Gauthier
4,846,724 A 7/1989 Sasaki et al.
4,878,155 A 10/1989 Conley
4,948,922 A 8/1990 Varadan et al.
4,970,354 A 11/1990 Iwasa et al.
4,992,060 A 2/1991 Meyer
5,000,700 A 3/1991 Masubuchi et al.
5,141,454 A 8/1992 Garrett et al.
5,150,086 A 9/1992 Ito
5,160,273 A * 11/1992 Carney ..... H01R 13/7034 439/108
5,168,252 A 12/1992 Naito
5,168,432 A 12/1992 Murphy et al.
5,266,055 A 11/1993 Naito et al.
5,280,257 A 1/1994 Cravens et al.
5,287,076 A 2/1994 Johnescu et al.
5,340,334 A 8/1994 Nguyen
5,346,410 A 9/1994 Moore, Jr.
5,456,619 A 10/1995 Belopolsky et al.
5,461,392 A 10/1995 Mott et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,822,195 A * 10/1998 Brench ..... H05K 9/0022 361/818
5,831,491 A 11/1998 Buer et al.
5,924,899 A 7/1999 Paagman
5,981,869 A 11/1999 Kroger
5,982,253 A 11/1999 Perrin et al.
6,019,616 A 2/2000 Yagi et al.
6,152,747 A 11/2000 McNamara
6,168,469 B1 1/2001 Lu
6,174,203 B1 1/2001 Asao
6,174,944 B1 1/2001 Chiba et al.
6,217,372 B1 4/2001 Reed
6,299,483 B1 10/2001 Cohen et al.
6,328,601 B1 12/2001 Yip et al.
6,347,962 B1 2/2002 Kline
6,350,134 B1 2/2002 Fogg et al.
6,364,711 B1 4/2002 Berg et al.
6,375,510 B2 4/2002 Asao
6,379,188 B1 4/2002 Cohen et al.
6,394,822 B1 * 5/2002 McNamara ..... H01R 13/6585 439/108
6,398,588 B1 6/2002 Bickford
6,409,543 B1 6/2002 Astbury, Jr. et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,086 B1 3/2003 MacMullin
6,537,087 B2 3/2003 McNamara et al.
6,551,140 B2 4/2003 Billman et al.
6,554,647 B1 4/2003 Cohen et al.
6,565,387 B2 5/2003 Cohen
6,579,116 B2 6/2003 Brennan et al.
6,582,244 B2 6/2003 Fogg et al.
6,595,802 B1 7/2003 Watanabe et al.
6,602,095 B2 8/2003 Astbury, Jr. et al.
6,616,864 B1 9/2003 Jiang et al.
6,652,318 B1 11/2003 Winings et al.
6,655,966 B2 12/2003 Rothermel et al.
6,709,294 B1 3/2004 Cohen et al.
6,713,672 B1 3/2004 Stickney
6,743,057 B2 6/2004 Davis et al.
6,776,659 B1 8/2004 Stokoe et al.
6,786,771 B2 9/2004 Gailus
6,814,619 B1 11/2004 Stokoe et al.
6,830,489 B2 12/2004 Aoyama
6,872,085 B1 3/2005 Cohen et al.
6,979,226 B2 12/2005 Otsu et al.
7,044,794 B2 5/2006 Consoli et al.
7,057,570 B2 6/2006 Irion, II et al.
7,074,086 B2 7/2006 Cohen et al.
7,094,102 B2 8/2006 Cohen et al.
7,108,556 B2 9/2006 Cohen et al.
7,163,421 B1 1/2007 Cohen et al.
7,285,018 B2 10/2007 Kenny et al.
7,335,063 B2 2/2008 Cohen et al.
7,494,383 B2 2/2009 Cohen et al.
7,540,781 B2 6/2009 Kenny et al.
7,581,990 B2 9/2009 Kirk et al.
7,588,464 B2 9/2009 Kim
7,722,401 B2 5/2010 Kirk et al.
7,731,537 B2 6/2010 Amleshi et al.
7,753,731 B2 7/2010 Cohen et al.
7,771,233 B2 8/2010 Gailus
7,794,240 B2 9/2010 Cohen et al.
7,874,873 B2 1/2011 Do et al.
7,887,371 B2 2/2011 Kenny et al.
7,906,730 B2 3/2011 Atkinson et al.
7,914,304 B2 3/2011 Cartier et al.
8,016,616 B2 9/2011 Glover et al.
8,083,553 B2 12/2011 Manter et al.
8,182,289 B2 5/2012 Stokoe et al.
8,215,968 B2 7/2012 Cartier et al.
8,272,877 B2 9/2012 Stokoe et al.
8,371,875 B2 2/2013 Gailus
8,382,524 B2 2/2013 Khilchenko et al.
8,535,065 B2 9/2013 Costello et al.
8,550,861 B2 * 10/2013 Cohen ..... H01R 12/58 439/858
8,632,361 B2 * 1/2014 Chen ..... H01R 13/6581 439/607.07
8,926,377 B2 1/2015 Kirk et al.
9,306,337 B2 * 4/2016 Yu ..... H01R 24/60
9,379,499 B2 * 6/2016 Miyoshi ..... H01R 24/60

(56) References Cited

U.S. PATENT DOCUMENTS

| | | | | |
|---|---|---|---|---|
| 9,520,689 | B2 | 12/2016 | Cartier, Jr. et al. | |
| 10,096,945 | B2 | 10/2018 | Cartier, Jr. et al. | |
| 2001/0012730 | A1 | 8/2001 | Ramey et al. | |
| 2001/0042632 | A1 | 11/2001 | Manov et al. | |
| 2002/0042223 | A1 | 4/2002 | Belopolsky et al. | |
| 2002/0089464 | A1 | 7/2002 | Joshi | |
| 2002/0098738 | A1 | 7/2002 | Astbury et al. | |
| 2002/0111068 | A1 | 8/2002 | Cohen et al. | |
| 2002/0111069 | A1 | 8/2002 | Astbury et al. | |
| 2004/0018757 | A1 | 1/2004 | Lang et al. | |
| 2004/0020674 | A1 | 2/2004 | McFadden et al. | |
| 2004/0115968 | A1 | 6/2004 | Cohen | |
| 2004/0121633 | A1 | 6/2004 | David et al. | |
| 2004/0121652 | A1 | 6/2004 | Gailus | |
| 2004/0196112 | A1 | 10/2004 | Welbon et al. | |
| 2004/0259419 | A1 | 12/2004 | Payne et al. | |
| 2005/0032430 | A1 | 2/2005 | Otsu et al. | |
| 2005/0070160 | A1 | 3/2005 | Cohen et al. | |
| 2005/0118869 | A1 | 6/2005 | Evans | |
| 2005/0133245 | A1 | 6/2005 | Katsuyama et al. | |
| 2005/0176835 | A1 | 8/2005 | Kobayashi et al. | |
| 2005/0283974 | A1 | 12/2005 | Richard et al. | |
| 2005/0287869 | A1 | 12/2005 | Kenny et al. | |
| 2006/0068640 | A1 | 3/2006 | Gailus | |
| 2006/0216969 | A1 | 9/2006 | Bright et al. | |
| 2007/0004282 | A1 | 1/2007 | Cohen et al. | |
| 2007/0021001 | A1 | 1/2007 | Laurx et al. | |
| 2007/0037419 | A1 | 2/2007 | Sparrowhawk | |
| 2007/0042639 | A1 | 2/2007 | Manter et al. | |
| 2007/0054554 | A1 | 3/2007 | Do et al. | |
| 2007/0059961 | A1 | 3/2007 | Cartier et al. | |
| 2007/0197095 | A1 | 8/2007 | Feldman et al. | |
| 2007/0218765 | A1 | 9/2007 | Cohen et al. | |
| 2007/0254517 | A1 | 11/2007 | Olson et al. | |
| 2008/0026638 | A1 | 1/2008 | Cohen et al. | |
| 2008/0096423 | A1* | 4/2008 | Huang | H01R 12/716 439/607.05 |
| 2008/0194146 | A1 | 8/2008 | Gailus | |
| 2008/0207023 | A1 | 8/2008 | Tuin et al. | |
| 2008/0246555 | A1 | 10/2008 | Kirk et al. | |
| 2008/0248658 | A1 | 10/2008 | Cohen et al. | |
| 2008/0248659 | A1 | 10/2008 | Cohen et al. | |
| 2008/0248660 | A1 | 10/2008 | Kirk et al. | |
| 2008/0264673 | A1 | 10/2008 | Chi et al. | |
| 2008/0267620 | A1 | 10/2008 | Cole et al. | |
| 2009/0011641 | A1 | 1/2009 | Cohen et al. | |
| 2009/0011645 | A1 | 1/2009 | Laurx et al. | |
| 2009/0051558 | A1 | 2/2009 | Dorval | |
| 2009/0098767 | A1 | 4/2009 | Long | |
| 2009/0117386 | A1 | 5/2009 | Vacanti et al. | |
| 2009/0130913 | A1 | 5/2009 | Yi et al. | |
| 2009/0221165 | A1 | 9/2009 | Buck et al. | |
| 2009/0239395 | A1 | 9/2009 | Cohen et al. | |
| 2009/0247012 | A1 | 10/2009 | Pan | |
| 2009/0291593 | A1 | 11/2009 | Atkinson et al. | |
| 2010/0081302 | A1 | 4/2010 | Atkinson et al. | |
| 2010/0099299 | A1 | 4/2010 | Moriyama et al. | |
| 2010/0144201 | A1 | 6/2010 | Defibaugh et al. | |
| 2010/0144203 | A1 | 6/2010 | Glover et al. | |
| 2010/0183141 | A1 | 7/2010 | Arai et al. | |
| 2010/0294530 | A1 | 11/2010 | Atkinson et al. | |
| 2011/0003509 | A1 | 1/2011 | Gailus | |
| 2011/0212650 | A1 | 9/2011 | Amleshi et al. | |
| 2011/0230095 | A1 | 9/2011 | Atkinson et al. | |
| 2011/0230096 | A1 | 9/2011 | Atkinson et al. | |
| 2011/0287663 | A1 | 11/2011 | Gailus et al. | |
| 2012/0077380 | A1 | 3/2012 | Minich et al. | |
| 2012/0094536 | A1 | 4/2012 | Khilchenko et al. | |
| 2012/0156929 | A1 | 6/2012 | Manter et al. | |
| 2012/0202363 | A1 | 8/2012 | McNamara et al. | |
| 2012/0202386 | A1 | 8/2012 | McNamara et al. | |
| 2012/0214344 | A1 | 8/2012 | Cohen et al. | |
| 2013/0012038 | A1 | 1/2013 | Kirk et al. | |
| 2013/0052876 | A1 | 2/2013 | Chen | |
| 2013/0078870 | A1 | 3/2013 | Milbrand, Jr. | |
| 2013/0109232 | A1 | 5/2013 | Paniaqua | |
| 2013/0196553 | A1 | 8/2013 | Gailus | |
| 2013/0225006 | A1 | 8/2013 | Khilchenko et al. | |
| 2013/0273781 | A1 | 10/2013 | Buck et al. | |
| 2014/0065883 | A1 | 3/2014 | Cohen et al. | |
| 2014/0233980 | A1 | 10/2014 | Yuan et al. | |
| 2016/0056593 | A1 | 2/2016 | Miyoshi et al. | |
| 2016/0064870 | A1 | 3/2016 | Yu et al. | |
| 2016/0149343 | A1 | 5/2016 | Atkinson et al. | |

FOREIGN PATENT DOCUMENTS

| | | | |
|---|---|---|---|
| CN | 1127783 | C | 11/2003 |
| CN | 101164204 | A | 4/2008 |
| CN | 201562814 | U | 8/2010 |
| CN | 101960674 | A | 1/2011 |
| CN | 202013961 | U | 10/2011 |
| CN | 202259895 | U | 5/2012 |
| CN | 102598430 | A | 7/2012 |
| CN | 203288811 | U | 11/2013 |
| CN | 105390882 | A | 3/2016 |
| CN | 105406254 | A | 3/2016 |
| EP | 1 207 587 | A2 | 5/2002 |
| EP | 1 779 472 | A1 | 5/2007 |
| EP | 2 169 770 | A2 | 3/2010 |
| EP | 2 988 376 | A1 | 2/2016 |
| GB | 1272347 | A | 4/1972 |
| JP | 7302649 | A2 | 11/1995 |
| JP | 2011-018651 | A | 1/2011 |
| JP | 2012-049035 | A2 | 3/2012 |
| JP | 2012-516021 | A | 7/2012 |
| JP | 2016-046074 | A2 | 4/2016 |
| TW | M444646 | U | 1/2013 |
| TW | 201613202 | A | 4/2016 |
| WO | WO 88/05218 | A1 | 7/1988 |
| WO | WO 99/56352 | A2 | 11/1999 |
| WO | WO 2004/059794 | A2 | 7/2004 |
| WO | WO 2004/059801 | A1 | 7/2004 |
| WO | WO 2006/002356 | A1 | 1/2006 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A1 | 10/2008 |

OTHER PUBLICATIONS

PCT/US2005/034605, Jan. 26, 2006, International Search Report and Written Opinion.

PCT/US2005/034605, Apr. 3, 2007 International Preliminary Report on Patentability.

PCT/US2006/025562, Oct. 31, 2007, International Search Report with Written Opinion.

PCT/US2006/025562, Jan. 9, 2008, International Preliminary Report on Patentability.

PCT/US2011/034747, Jul. 28, 2011, International Search Report and Written Opinion.

PCT/US2011/034747, Nov. 15, 2012, International Preliminary Report on Patentability.

PCT/US2010/056482, Mar. 14, 2011, International Search Report and Written Opinion.

PCT/US2010/056482, May 24, 2012, International Preliminary Report on Patentability.

PCT/US2010/056482, Jan. 25, 2011, International Search Report and Written Opinion.

PCT/US2010/056495, May 24, 2012, International Preliminary Report on Patentability.

PCT/US2011/026139, Nov. 22, 2011, International Search Report and Written Opinion.

PCT/US2011/026139, Sep. 7, 2012, International Preliminary Report on Patentability.

PCT/US2012/023689, Sep. 12, 2012, International Search Report and Written Opinion.

PCT/US2012/023689, Aug. 15, 2013, International Preliminary Report on Patentability.

PCT/US2012/060610, Mar. 29, 2013, International Search Report and Written Opinion.

(56) References Cited

OTHER PUBLICATIONS

PCT/US2012/060610, May 1, 2014, International Preliminary Report on Patentability.
PCT/US2014/026381, Aug. 12, 2014, International Search Report and Written Opinion.
PCT/US2014/026381, Sep. 24, 2015, International Preliminary Report on Patentability.
PCT/SG2017/050277, Oct. 24, 2017, International Search Report and Written Opinion.
PCT/SG2017/050277, Dec. 13, 2018, International Preliminary Report on Patentability.
Chinese communication for Application No. 201780030329.4 dated Jul. 22, 2019.
Extended European Search Report for European Application No. EP 11166820.8 dated Jan. 24, 2012.
International Search Report and Written Opinion for International Application No. PCT/US2010/056482 dated Mar. 14, 2011.
International Preliminary Report on Patentability for International Application No. PCT/US2010/056482 dated May 24, 2012.
International Search Report and Written Opinion for International Application No. PCT/US2010/056495 dated Jan. 25, 2011.
International Preliminary Report on Patentability for International Application No. PCT/US2010/056495 dated May 24, 2012.
International Search Report and Written Opinion for International Application No. PCT/US2011/026139 dated Nov. 22, 2011.
International Preliminary Report on Patentability for International Application No. PCT/US2011/026139 dated Sep. 7, 2012.
International Search Report and Written Opinion for International Application No. PCT/US2012/023689 dated Sep. 12, 2012.
International Preliminary Report on Patentability for International Application No. PCT/US2012/023689 dated Aug. 15, 2013.
International Search Report and Written Opinion for International Application No. PCT/US2012/060610 dated Mar. 29, 2013.
International Preliminary Report on Patentability for International Application No. PCT/US2012/060610 dated May 1, 2014.
International Search Report and Written Opinion for International Application No. PCT/US2014/026381 dated Aug. 12, 2014.
International Preliminary Report on Patentability for International Application No. PCT/US2014/026381 dated Sep. 24, 2015.
International Preliminary Report on Patentability for International Application No. PCT/SG2017/050277 dated Dec. 13, 2018.
International Search Report and Written Opinion for International Application No. PCT/SG2017/050277 dated Oct. 24, 2017.
International Search Report and Written Opinion for International Application No. PCT/US2005/034605 dated Jan. 26, 2006.
International Preliminary Report on Patentability for International Application No. PCT/US2005/034605 dated Apr. 3, 2007.
International Search Report with Written Opinion for International Application No. PCT/US2006/025562 dated Oct. 31, 2007.
International Preliminary Report on Patentability for International Application No. PCT/US2006/025562 dated Jan. 9, 2008.
International Preliminary Report on Patentability for International Application No. PCT/US2011/034747 dated Nov. 15, 2012.
International Search Report and Written Opinion for International Application No. PCT/US2011/034747 dated Jul. 28, 2011.
[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013. 2 pages.
Beaman, High Performance Mainframe Computer Cables. 1997 Electronic Components and Technology Conference. 1997;911-7.
Shi et al., Improving Signal Integrity in Circuit Boards by Incorporating Absorbing Materials. 2001 Proceedings. 51st Electronic Components and Technology Conference, Orlando FL. 2001:1451-56. 6 pages.
CN 2017800303294, Jul. 22, 2019, Chinese Communication.

* cited by examiner

HIGH SPEED ELECTRICAL CONNECTOR

CROSS-REFERENCE TO RELATED APPLICATIONS

This application is a 35 U.S.C. § 371 National Phase filing of International Application No. PCT/SG2017/050277, filed May 31, 2017, entitled "HIGH SPEED ELECTRICAL CONNECTOR," which claims priority to and the benefit of Indian Patent Application No. 201641018893, filed Jun. 1, 2016, entitled "HIGH SPEED ELECTRICAL CONNECTOR." The entire contents of these applications are incorporated herein by reference in their entirety.

FIELD OF THE INVENTION

The present invention relates to an electrical connector and in particular to a high speed electrical connector.

DETAILED DESCRIPTION

Figure 1:
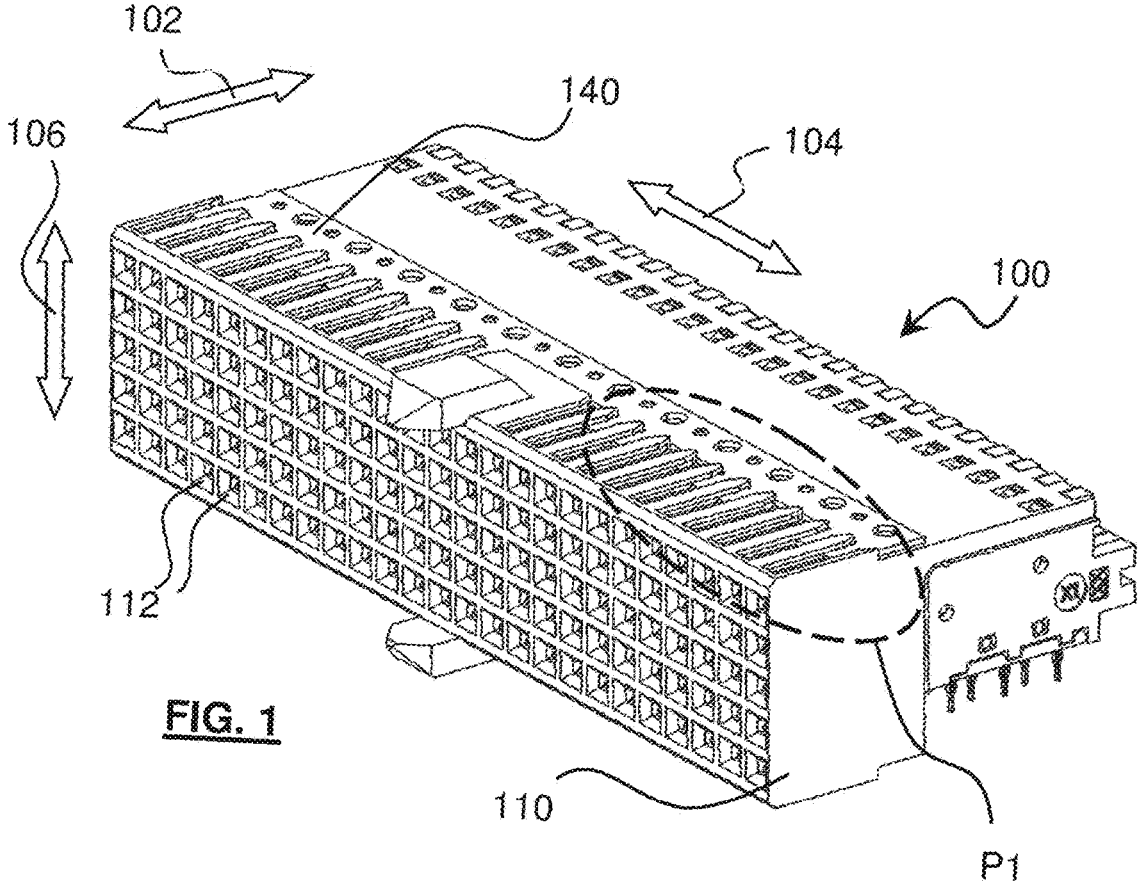
FIG. 1 is a perspective view of a high speed electrical connector according to one embodiment of the present invention.
Figure 2:
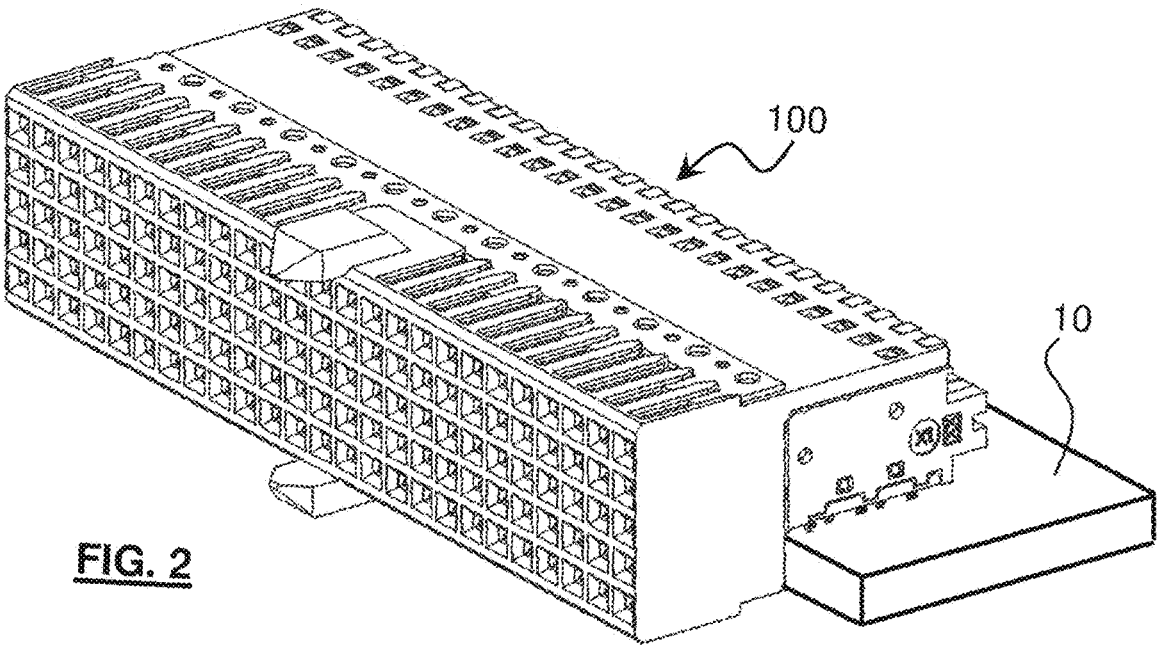
FIG. 2 is a perspective of the a high speed electrical connector shown in FIG. 1 when mounted to a printed circuit board.
Figure 3:
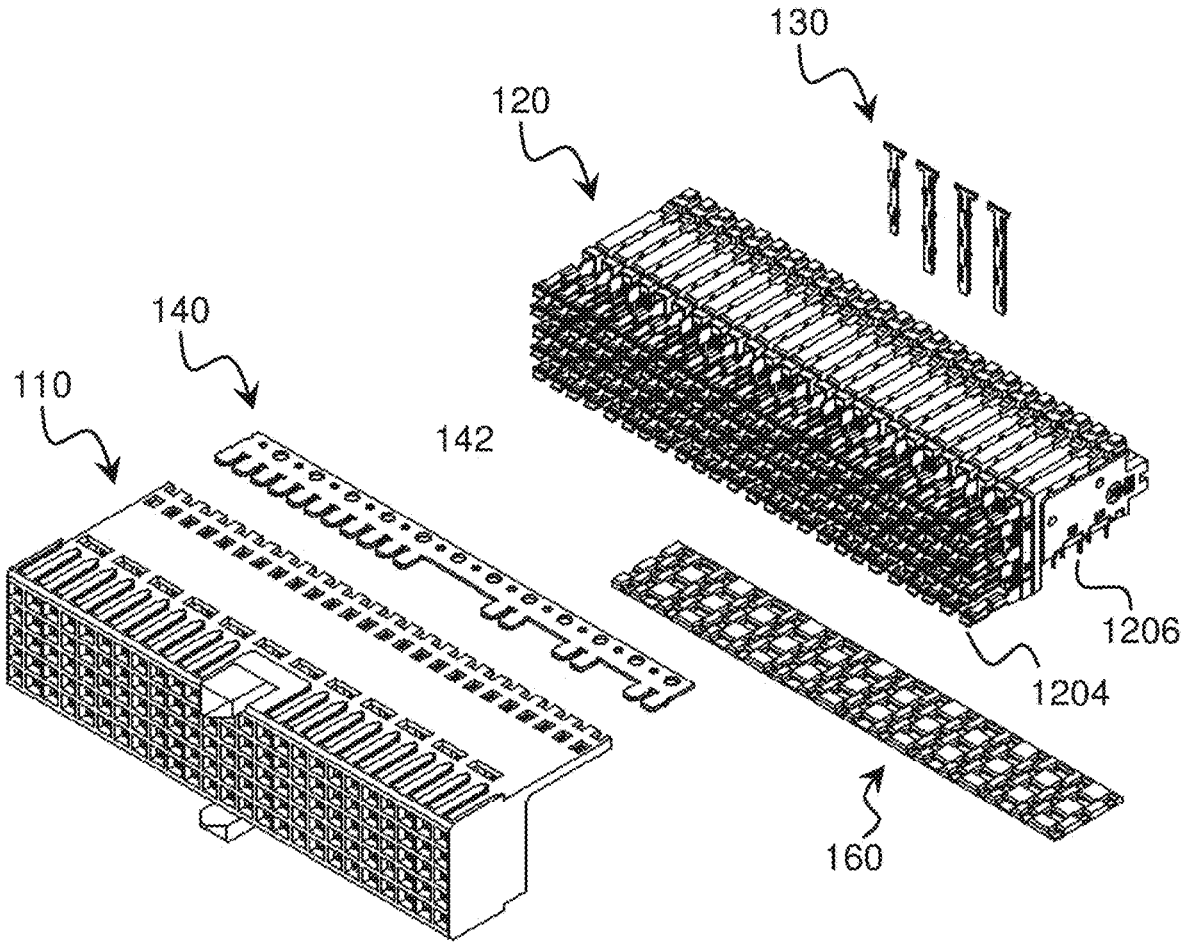
FIG. 3 is an exploded perspective view of FIG. 1.
Figure 4:
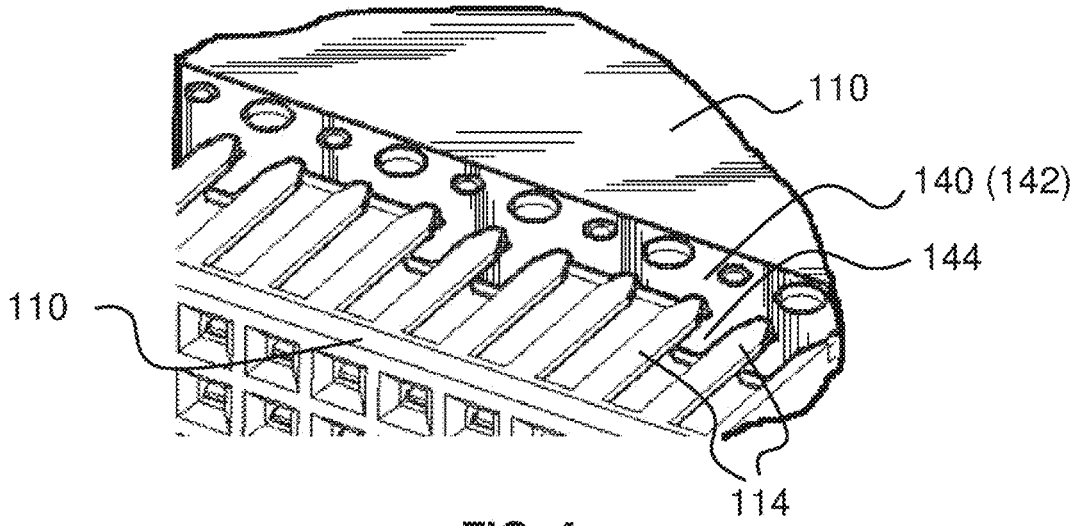
FIG. 4 is a partial enlarged view of portion P1 of FIG. 1.
Figure 5:
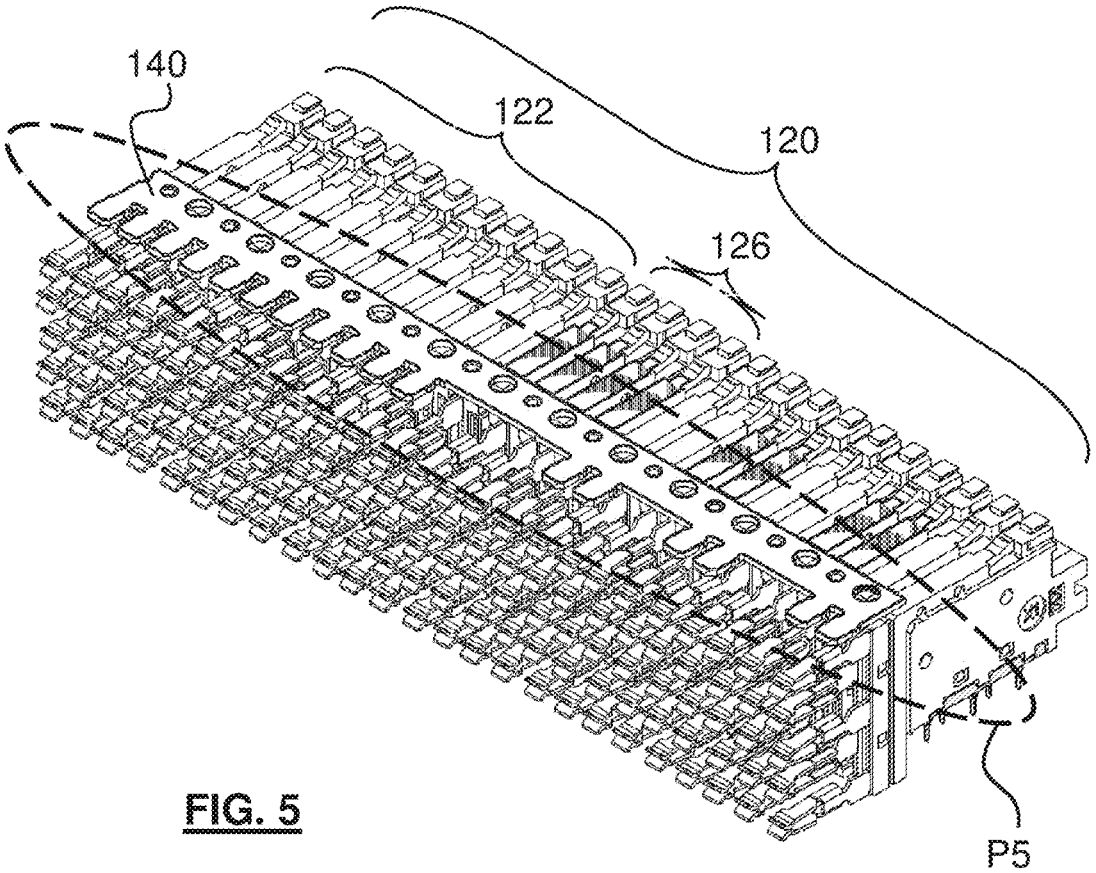
FIG. 5 is a perspective view of a high speed electrical connector shown in FIG. 1 where the housing is omitted.

According to an aspect of the disclosure, an electrical connector is provided. The electrical connector comprises a housing having a width direction and a mounting direction orthogonal to the width direction, a plurality of low speed signal contacts arranged in the housing along the width direction, a plurality of high speed signal contacts arranged in the housing along the width direction, a plurality of ground bars, each ground bar being disposed between adjacent two of the low signal contacts; a member having a body disposed along the width direction, wherein fingers extend laterally from the body. Each of the fingers are in alignment with one of the low speed signal contacts along the mounting direction. Two or more high speed signal contacts being are disposed between adjacent fingers.

In some embodiments, the body is associated with a support member attached to the housing.

In some embodiments, the body is associated with a shield attached to the housing.

In some embodiments, the housing comprises ridges formed on a top surface thereof, and the fingers are inserted between adjacent ridges.

In some embodiments, the low speed signal contacts are positioned spaced apart by a first contact pitch and the high speed signal contacts are positioned spaced apart by a second contact pitch. In some embodiments, the second contact pitch is substantially the same as the first contact pitch.

In some embodiments, the fingers in a first segment of the body are separated by a first finger pitch and the fingers in a second segment of the body are separated by a second finger pitch. In some embodiments, the first finger pitch is the same as the first contact pitch. In some embodiments, the second finger pitch is greater than the second contact pitch.

In some embodiments, each of the fingers is in alignment with one of the low speed signal contacts in the first segment.

In some embodiments, two or more high speed contacts are disposed between adjacent fingers in the second segment.

In some embodiments, two or more high speed signal contacts are exposed between the adjacent fingers in the second segment.

According to another aspect of the disclosure, a method of constructing an electrical connector is provided. The method comprises attaching a body to a housing of the electrical connector having a width direction and a mounting direction orthogonal to the width direction, wherein a plurality of low speed signal contacts and a plurality of high speed signal contacts are arranged in the housing along the width direction, and the body is disposed along the width direction, and wherein fingers extend laterally from the body, and aligning each of the fingers with one of the low speed signal contacts, wherein two or more high speed signal contacts are disposed between adjacent fingers.

In some embodiments, the method further comprises inserting the fingers between ridges formed on a top surface of the housing.

In some embodiments, attaching the body to the housing of the electrical connector comprises attaching a support member having the body to the housing.

In some embodiments, attaching the body to the housing of the electrical connector comprises attaching a shield having the body to the housing.

In some embodiments, the method further comprises exposing the two or more high speed signal contacts between the adjacent fingers.

According to another aspect of the disclosure, a method of operating an electrical connector is provided, where the electrical connector comprises a conductive body attached to a housing of the electrical connector having a width direction and a mounting direction orthogonal to the width direction, and the conductive body is disposed along the width direction, and wherein fingers extend laterally from the conductive body such that the fingers are aligned with first type signal contacts and two or more second type signal contacts are disposed between adjacent fingers. The method comprises coupling low speed signals through the first type signal contacts and coupling high speed signals through the second type signal contacts.

As shown in FIGS. 1 to 6, according to one embodiment, a high speed electrical connector 100 has a housing 110 and contacts 120 disposed in housing 110. Housing 110 has a mating direction 102 along which electrical connector 100 is mateable to a counterpart connector (not shown in the drawings), a width direction 104 orthogonal to mating direction 102, and a height direction 106 orthogonal to mating direction 102 and width direction 104. Formed in housing 110 there is an array of compartments 112, arranged along width direction 104 and height direction 106, respectively. In each compartment 112, there is disposed one of the contacts 120.

Contacts 120 include low speed signal contacts 122 and high speed signal contacts 126. Electrical connector 100 includes one or more ground bars 130 and a support member 140.

Each ground bar 130 is disposed between adjacent contacts 120. Housing 110 has ridges 114 formed on top surface thereof. Support member 140 has a main body 142 and fingers 144 extending laterally from main body 142. Support member 140 is attached to housing 110 with main body 142 arranged parallel to width direction 104, and with each finger 144 inserted between adjacent ridges 114 of housing 110. Each finger 144 is in alignment with one of the low speed signal contacts 122 located underneath one of the fingers 144, along height direction 106.

Figure 6:
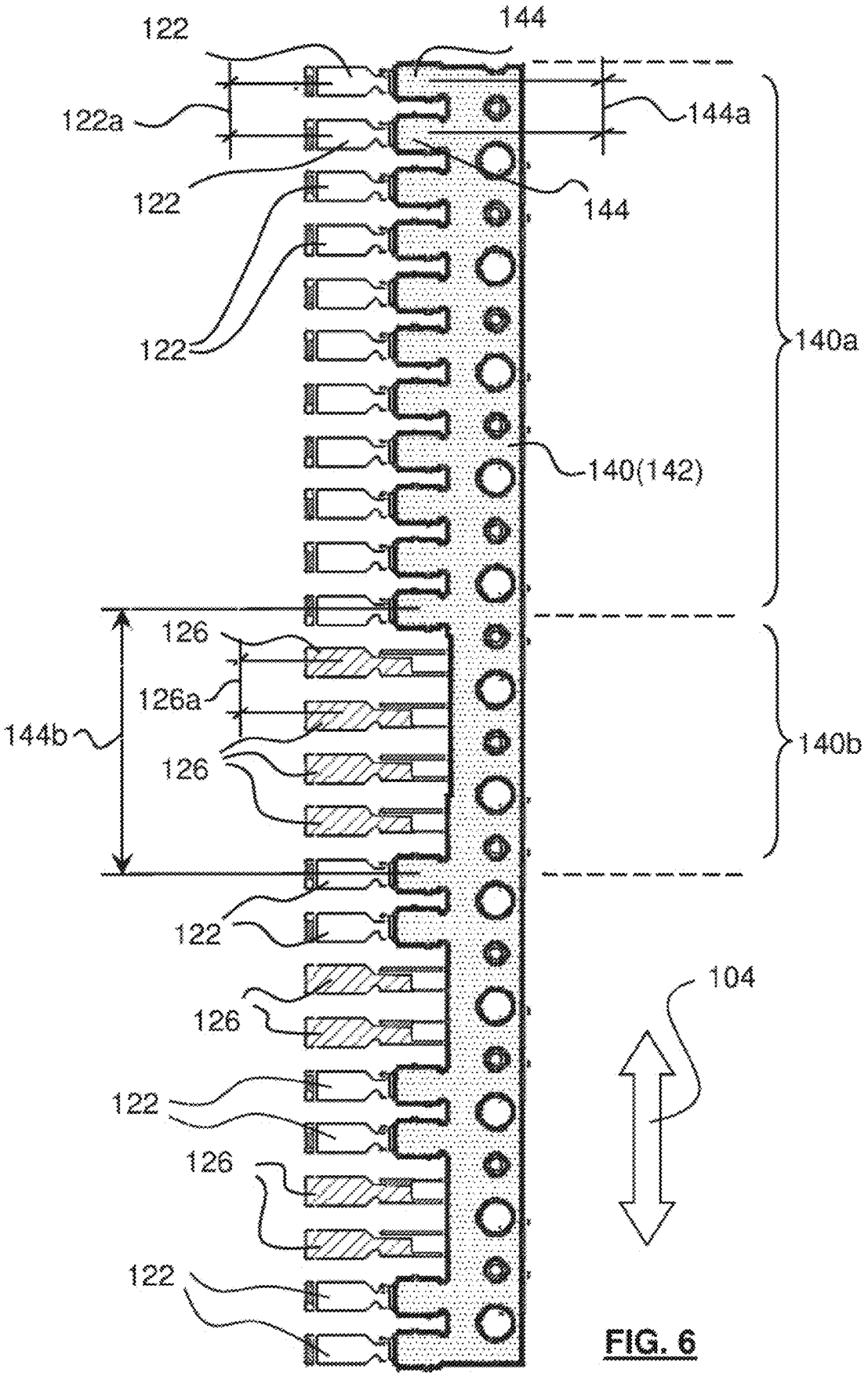
FIG. 6 is a top view of portion P5 of FIG. 5.
Figure 7:
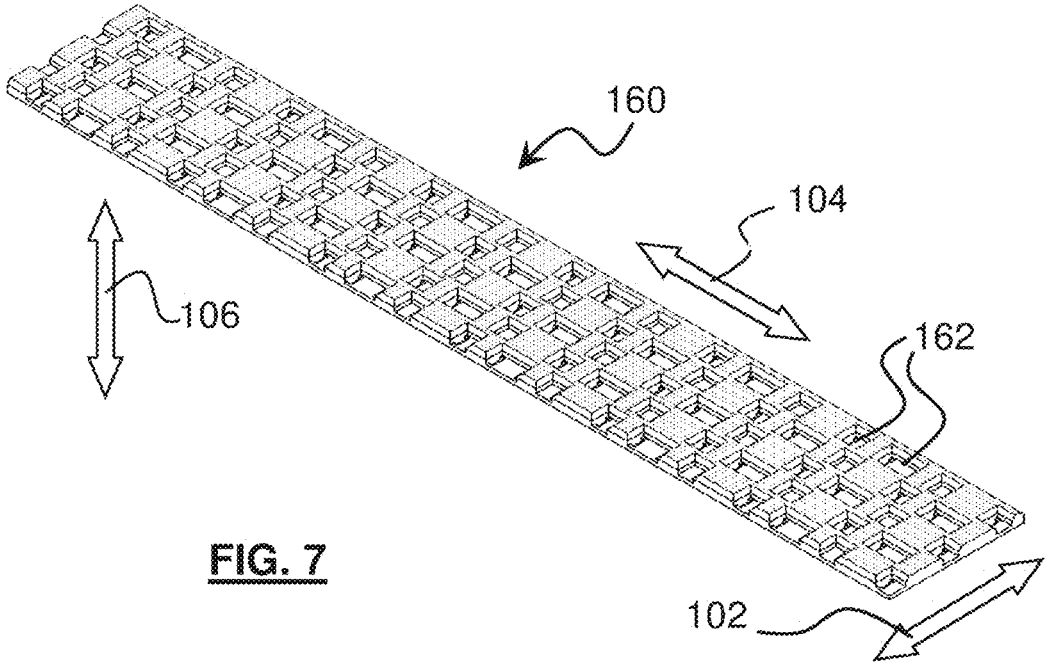
FIG. 7 is a perspective view of the contact aligner of the electrical connector shown in FIG. 1.
Figure 9B:
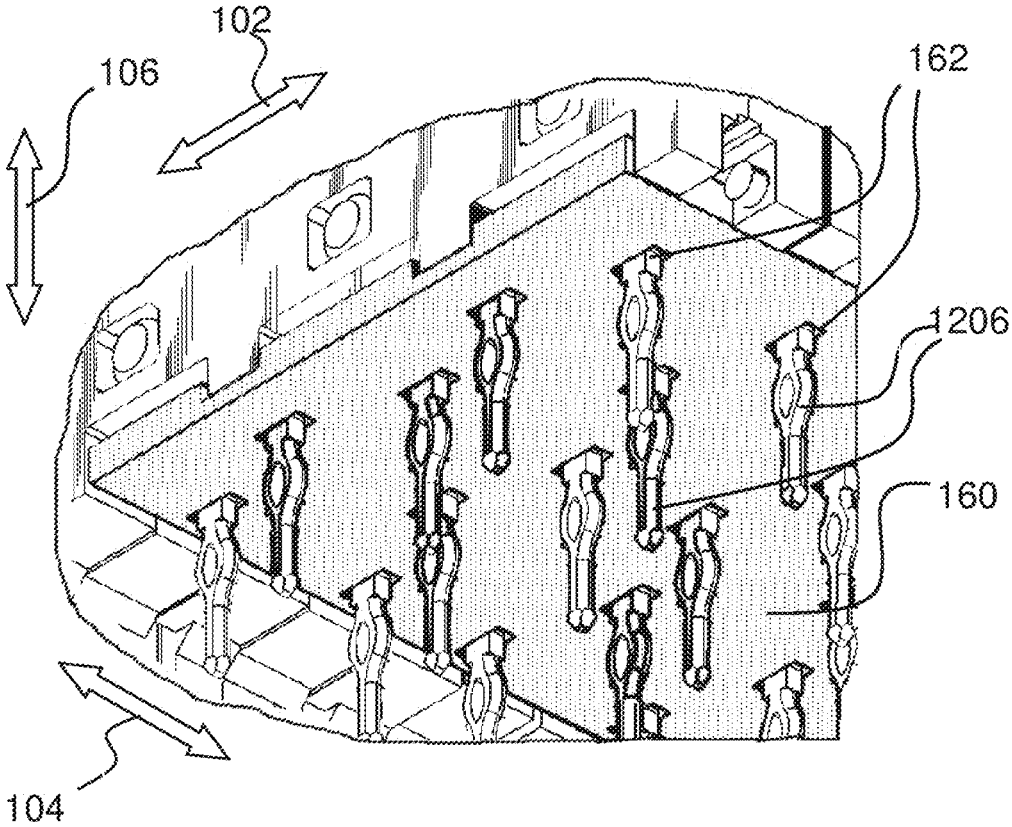
FIG. 9B is an enlarged partial view of FIG. 9A.
Figure 8:
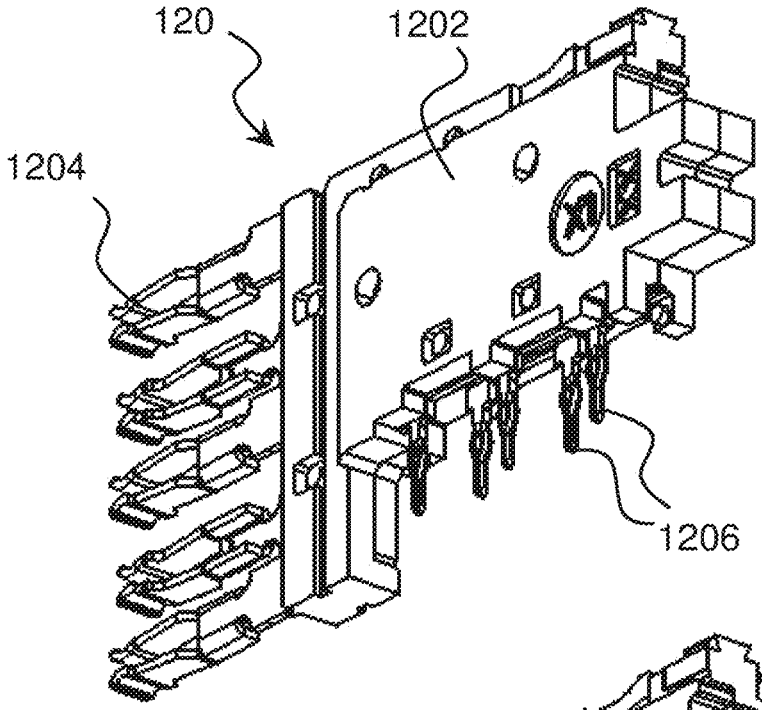
FIG. 8 is a perspective bottom view of contact assemblies of the electrical connector shown in FIG. 1.
Figure 9A:
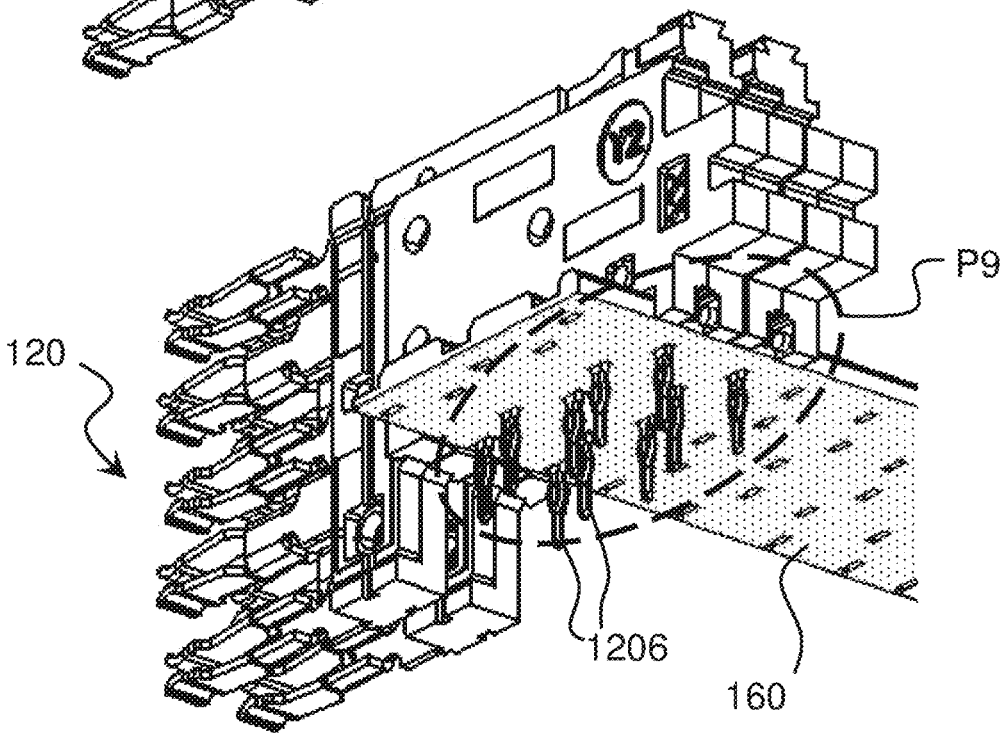
FIG. 9A is a perspective bottom view of a contact assembly of the electrical connector shown in FIG. 1 and the contact aligner of FIG. 7 attached to the contact assemblies.
Figure 10:
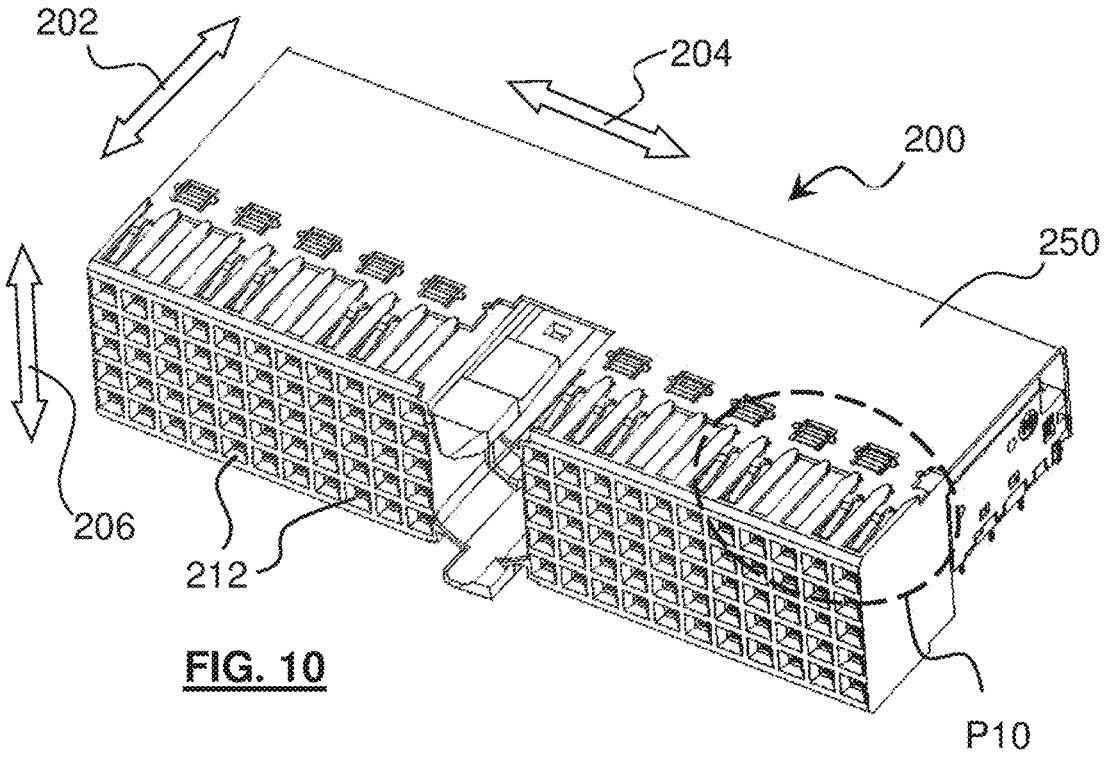
FIG. 10 is a perspective view of a high speed electrical connector according another embodiment of the present invention.
Figure 11:
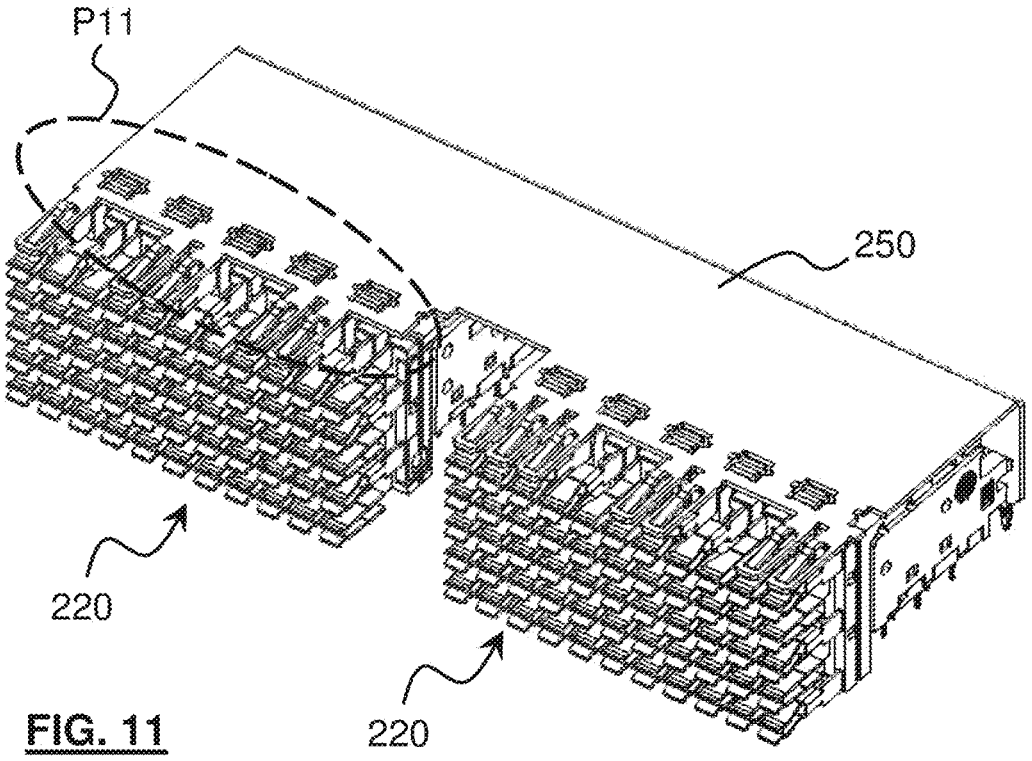
FIG. 11 is a perspective view of a high speed electrical connector shown in FIG. 10 where the housing is omitted.
Figure 12:
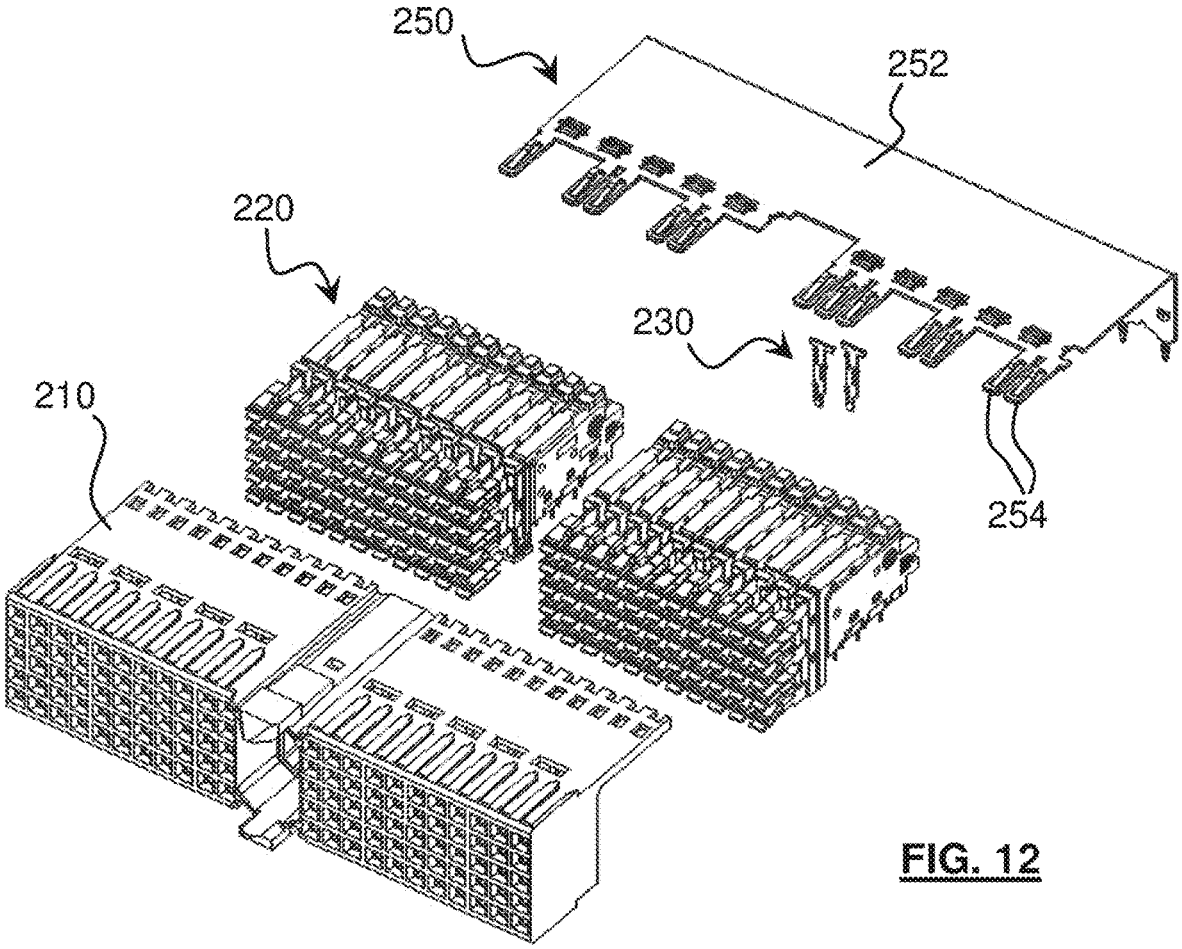
FIG. 12 is an exploded perspective view of FIG. 10.
Figure 13:
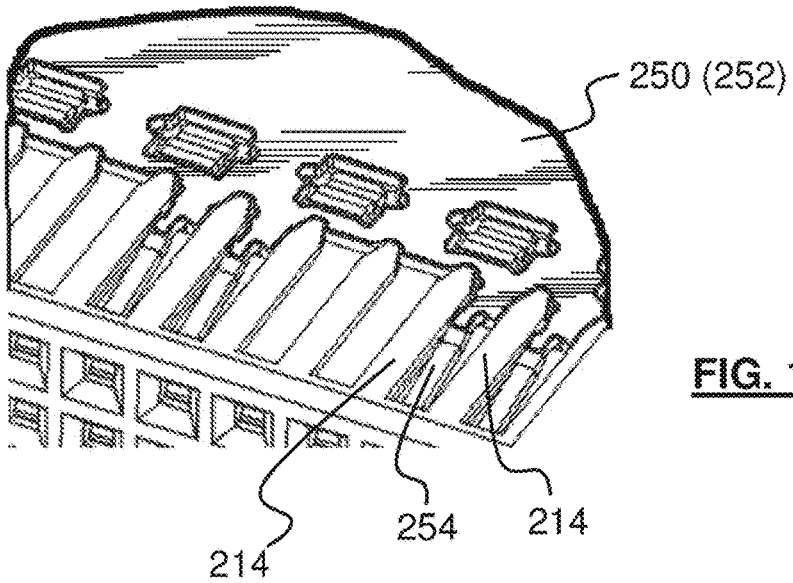
FIG. 13 is a partial enlarged view of portion P10 of FIG. 10.

As shown in FIG. 6, low speed signal contacts 122 are positioned spaced apart from each other by first contact pitch 122*a*. Likewise, high speed signal contacts 126 are positioned spaced apart from each other by second contact pitch 126*a* which is substantially the same as first contact pitch 122*a*.

Support member 140 includes first segment 140*a* and second segment 140*b*, along width direction 104. Fingers 144 of support element 140 in first segment 140*a* are separated from each other, by first finger pitch 144*a*. Fingers 144 of support element 140 on second segment 140*b* are separated from each other, by second finger pitch 144*b*. First finger pitch 144*a* is the same as first contact pitch 122*a*. Second finger pitch 144*b* is greater than second contact pitch 126*a*, e.g. as that shown in FIG. 6, second finger pitch 144*b* is five times as second contact pitch 126*a*, i.e. there are disposed four high speed contacts 126 between adjacent fingers 144 in the second segment 140*b*. With first and second finger pitch 144*a*, 144*b* configured in the above-illustrated manner, each finger 144 is in alignment with one of the low speed contacts 122, and two or more high speed contacts 126 are disposed between two adjacent fingers 144. As such, high speed contacts 126 are exposed between adjacent fingers 144 of support element 140. Fingers 144 are positioned away from high speed contacts 126 to achieve better signal integrity through reduction in insertion loss and improvement in resonance performance.

Electrical connector 100 may include a contact aligner 160 attached to bottom side of housing 110. With reference to FIGS. 3, 7, 8, 9A and 9B, contact aligner 160 is generally plate-shaped having apertures 162 formed thereon. Contacts 120 may be included in a type of Insert-Molded Leadframe Assembly (IMLA) having mating portions 1204 disposed in compartment 112, and tail portions 1206 extending outwardly from housing 110, for mounting to PCB 10. Each tail portion 1206 is press-fitted and passes through a corresponding aperture 162 of contact aligner 160. Retained by contact aligner 160, tail portions 1206 are better aligned in position, and become stronger to resist deflection with respect to mating direction 102 and width direction 104. Structural integrity and robustness of electrical connector 100 is improved.

According to another embodiment, as shown in FIGS. 10 to 14, a high speed electrical connector 200 has a housing 210 and contacts 220 disposed in housing 210. Electrical connector 200 includes one or more ground bars 230. Each ground bar 230 is disposed between adjacent contacts 220. Housing 210 has a mating direction 202 along which electrical connector 200 is mateable to a counterpart connector (not shown in the drawings), a width direction 204 orthogonal to mating direction 202, and a height direction 206 orthogonal to mating direction 202 and width direction 204. Formed in housing 200 there is an array of compartments 212, arranged along width direction 204 and height direction 206, respectively. In each compartment 212, there is disposed one of the contacts 220.

Contacts 220 includes low speed signal contacts 222 and high speed signal contacts 226. Electrical connector 200 include a shield 250 attached to housing 210. Housing 210 has ridges 214 formed on top surface thereof. Shield 250 has a main body 252 and fingers 254 extending laterally from main body 252. Shield 250 is attached to housing 210 with main body 252 arranged parallel to width direction 204 and covering the top surface of housing 210, and with each finger 254 inserted between adjacent ridges 214 of housing 210. Main body 252 of shield 250 engages and is in electrical contact with ground bars 230. Each finger 254 is in alignment with one of the low speed signal contacts 222 located underneath one of the fingers 254, along height direction 206.

Figure 14:
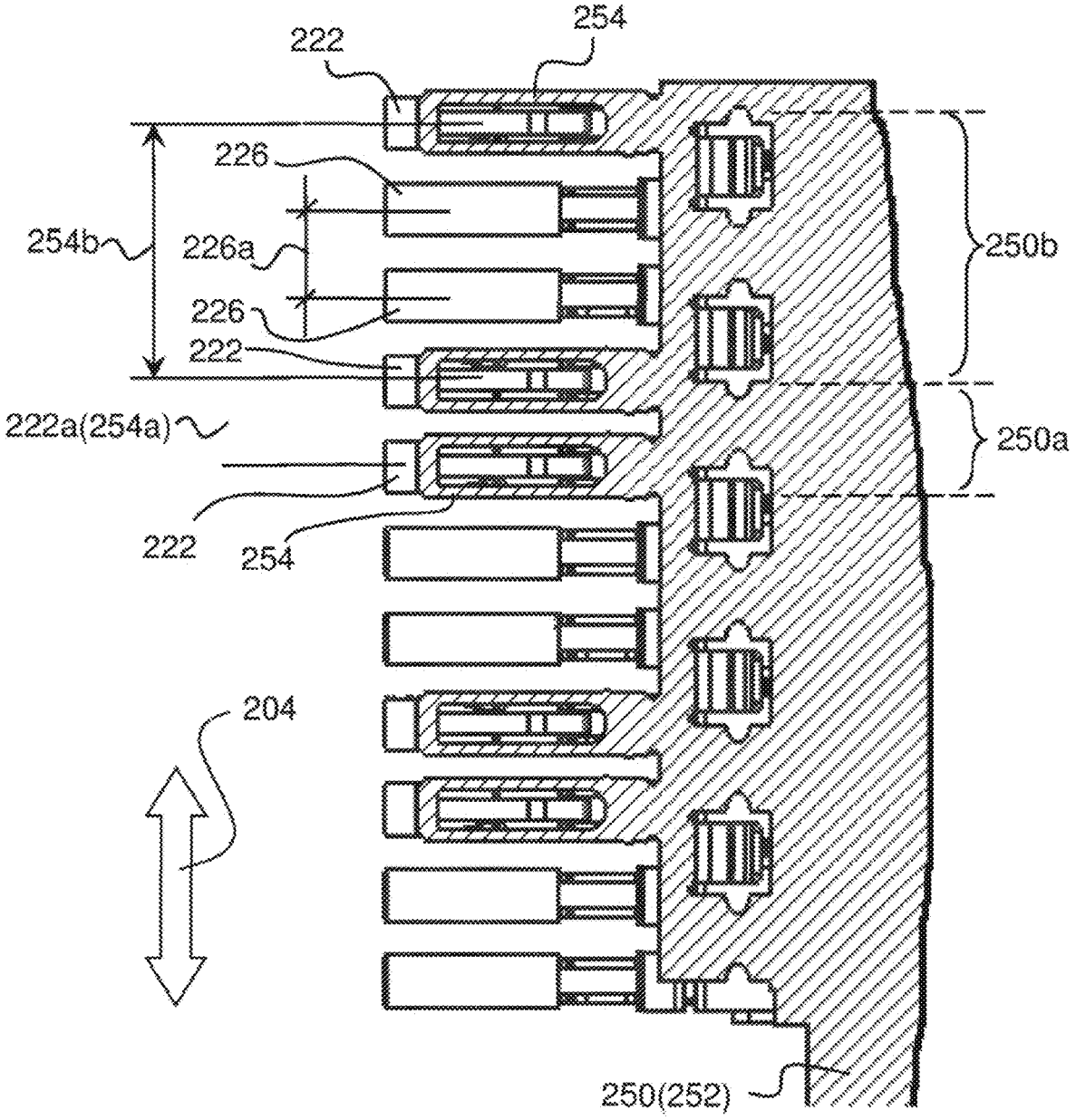
FIG. 14 is a top view of portion P11 of FIG. 11.

As shown in FIG. 14, low speed signal contacts 222 are positioned spaced apart from each other by first contact pitch 222*a*. Likewise, high speed signal contacts 226 are positioned spaced apart from each other by second contact pitch 226*a* which is substantially the same as first contact pitch 122*a*.

Shield 250 includes first segment 250*a* and second segment 250*b* along width direction 204. Fingers 254 in first segment 250*a* are separated from each other by first finger pitch 254*a*. Fingers 254 in second segment 250*b* are separated from each by second finger pitch 254*b*. Second finger pitch 254*b* is greater than second contact pitch 226*a*, e.g. as that shown in FIG. 14, second finger pitch 254*b* is three times as second contact pitch 226*a*, i.e. there are disposed two high speed contacts 226 between adjacent fingers 254 in the second segment 250*b*. With first and second finger pitch 254*a*, 254*b* configured in the above-illustrated manner, each finger 254 is in alignment with one of the low speed contacts 252, and two or more high speed contacts 226 are disposed between two adjacent fingers 254. As such, high speed contacts 226 are exposed between adjacent fingers 244 of shield 250. Fingers 254 are positioned away from high speed contacts 226 to achieve better signal integrity through reduction in insertion loss and improvement in resonance performance. Shield 250 has the function to hold and engage ground bars 230. Engagement of shield 250 with ground bars 230 improves the signal integrity performance through lower impedance and improved shielding performance.

According to some embodiments, the contacts 220 may also be included in a type of Insert-Molded Leadframe Assembly (IMLA). It will be appreciated that the leadframe assemblies are prepared using conventional techniques. In some embodiments, the housings 110, 210 associated with the leadframe assemblies are insulative housings.

According to some embodiments, at least some portions of the support member 140 and shield 250 are conductive.

According to some embodiments, the fingers can be springy and made of metal.

It should be appreciated that the exemplary embodiments are only examples, and are not intended to limit the scope, applicability, operation, or configuration of the invention in any way. Rather, the foregoing detailed description will provide those skilled in the art with a convenient road map for implementing an exemplary embodiment of the invention, it being understood that various changes may be made in the function and arrangement of elements and method of operation described in an exemplary embodiment without departing from the scope of the invention as set forth in the appended claims.

The invention claimed is:

1. An electrical connector, comprising:

a housing having a width direction and a mounting direction orthogonal to the width direction;

a plurality of low speed signal contacts arranged in the housing along the width direction;

a plurality of high speed signal contacts arranged in the housing along the width direction;

a plurality of ground bars, each ground bar being disposed between adjacent two of the low signal contacts;

a member having a body disposed along the width direction, wherein fingers extend laterally from the body;

wherein each of the fingers is in alignment with one of the low speed signal contacts along the mounting direction; and wherein two or more high speed signal contacts are disposed between adjacent fingers.

2. The electrical connector as recited in claim 1, wherein the body is associated with a support member attached to the housing.

3. The electrical connector as recited in claim 1, wherein the body is associated with a shield attached to the housing.

4. The electrical connector as recited in claim 1, wherein the housing comprises ridges formed on a top surface thereof, and the fingers are inserted between adjacent ridges.

5. The electrical connector as recited in claim 1, wherein the low speed signal contacts are positioned spaced apart by a first contact pitch and the high speed signal contacts are positioned spaced apart by a second contact pitch.

6. The electrical connector as recited in claim 5, wherein the second contact pitch is substantially the same as the first contact pitch.

7. The electrical connector as recited in claim 5, wherein the fingers in a first segment of the body are separated by a first finger pitch and the fingers in a second segment of the body are separated by a second finger pitch.

8. The electrical connector as recited in claim 7, wherein the first finger pitch is the same as the first contact pitch.

9. The electrical connector as recited in claim 8, wherein the second finger pitch is greater than the second contact pitch.

10. The electrical connector as recited in claim 9, wherein each of the fingers is in alignment with one of the low speed signal contacts in the first segment.

11. The electrical connector as recited in claim 10, wherein the two or more high speed contacts are disposed between adjacent fingers in the second segment.

12. The electrical connector as recited in claim 10, wherein the two or more high speed signal contacts are exposed between the adjacent fingers in the second segment.

13. A method of constructing an electrical connector, the method comprising:

attaching a body to a housing of the electrical connector having a width direction and a mounting direction orthogonal to the width direction, wherein a plurality of low speed signal contacts and a plurality of high speed signal contacts are arranged in the housing along the width direction, and the body is disposed along the width direction, and wherein fingers extend laterally from the body;

aligning each of the fingers with one of the low speed signal contacts, wherein two or more high speed signal contacts are disposed between adjacent fingers.

14. The method as recited in claim 13, further comprising:

inserting the fingers between ridges formed on a top surface of the housing.

15. The method as recited in claim 13, wherein attaching the body further comprises:

attaching a support member having the body to the housing.

16. The method as recited in claim 13, wherein attaching the body further comprises:

attaching a shield having the body to the housing.

17. The method as recited in claim 13, further comprising:

exposing the two or more high speed signal contacts between the adjacent fingers.

18. A method of operating an electrical connector, comprising a conductive body attached to a housing of the electrical connector having a width direction and a mounting direction orthogonal to the width direction, and the conductive body is disposed along the width direction, and wherein fingers extend laterally from the conductive body such that the fingers are aligned with first type signal contacts and two or more second type signal contacts are disposed between adjacent fingers, the method comprising:

coupling low speed signals through the first type signal contacts; and coupling high speed signals through the second type signal contacts.

* * * * *